United States Patent [19]

Palau et al.

[11] Patent Number: 4,461,325

[45] Date of Patent: Jul. 24, 1984

[54] ELECTROMAGNETIC DEVICE FOR CONTROLLING DOBBIES AND OTHER WEAVING SYSTEMS

[75] Inventors: Joseph Palau, Duingt; Jean-Paul Froment, Doussard, both of France

[73] Assignee: S.A. des Etablissements Staubli, Faverges, France

[21] Appl. No.: 407,513

[22] Filed: Aug. 12, 1982

[30] Foreign Application Priority Data

Nov. 5, 1981 [FR] France ..... 81 21106

[51] Int. Cl.[3] ..... D03C 1/00

[52] U.S. Cl. ..... 139/68; 139/66 R; 139/76; 139/331

[58] Field of Search ..... 139/66 R, 76, 71, 68, 139/74, 331

[56] References Cited

U.S. PATENT DOCUMENTS

| | | | |
|---|---|---|---|
| 3,441,060 | 4/1969 | Schwarz | 139/68 |
| 4,182,380 | 1/1980 | Palau | 139/68 |
| 4,387,741 | 6/1983 | Palau et al. | 139/76 |

FOREIGN PATENT DOCUMENTS

| | | | |
|---|---|---|---|
| 0047791 | 3/1982 | European Pat. Off. | 139/76 |
| 2741199 | 2/1979 | Fed. Rep. of Germany | 139/76 |
| 2428693 | 1/1980 | France | 139/68 |
| 485887 | 3/1970 | Switzerland | 139/68 |
| 761627 | 9/1980 | U.S.S.R. | 139/66 R |

*Primary Examiner*—James Kee Chi

*Attorney, Agent, or Firm*—Dowell & Dowell

[57] ABSTRACT

The present invention relates to electromagnetic devices for controlling dobbies and other weaving systems, wherein the control unit which contains the electro-magnets is borne by an oscillating frame on which is mounted an equal number of selectors associated with a spring which tends to move them away from the associated poles of magnetic attraction. Each selector acts selectively on the actuating hooks of the dobby, and a fixed stop ensuring its return into applied position against the magnet upon return into a non-actuating position. The device is applicable to the control of a dobby with double swinging levers or to the control of a rotating dobby.

5 Claims, 14 Drawing Figures

ELECTROMAGNETIC DEVICE FOR CONTROLLING DOBBIES AND OTHER WEAVING SYSTEMS

The present invention relates to dobbies in weaving looms, it being understood, however, that this term generically encompasses various different types of systems associated with weaving machines with a view to forming the shed for the passage of the weft yarns.

It is known that, in its conventional form, a dobby comprises a single control device which, as a function of a variable program corresponding to the particular weave desired for the fabric being woven on the weaving machine, vertically actuates a series of heddle frames for opening of the warp yarns. Due to the tension of the yarns which pass through the mails of the heddles of the same frame, the vertical displacement of the latter involves considerable effort, so that an independent amplifier system must be interposed between the control device and the heddle control cables or rods connected to each of the different frames of the dobby, the assembly formed by each frame and by its amplifier system constituting what is called a "needle" of the dobby.

The control device firstly comprises a reading apparatus for reading the weaving program, this program, depending on the case, being in the form of a continuous web of perforated paper, an articulated series of punched cards, a chain or a peg-bearing cylinder, etc . . . . The information picked up by the reading apparatus must be converted into mechanical movements by a relatively complex actuating mechanism, incorporating a series of mobile rods actuated by driving knives with reciprocating movement or by rotating cams. At each of the needles of the dobby, this actuating mechanism comprises at least one output member which acts selectively on one or the other of a pair of pivoting hooks ensuring actuation of the corresponding amplifier system, the latter being of the rotating type or of the type with double swinging levers, depending on the case.

It has been envisaged to simplify the construction of the control device by replacing the actuating mechanism interposed between the reading apparatus and the pairs of pivoting actuating hooks, by two series of electro-magnets, each series comprising a number of electro-magnets equal to that of the needles of the dobby. In fact, it will be readily appreciated that each of these electro-magnets may be selectively energized by the reading apparatus in order to act, via a corresponding mobile selector member, on that one of the two pivoting hooks of the needle envisaged with which it is associated.

However, attempts made along these lines have not been entirely satisfactory in practice. Ordinarily, the electro-magnets of each series are mounted side by side in an insulating unit permanently fixed on the frame of the dobby, and if the corresponding row of mobile members associated with each unit is taken into account, a physically very cumbersome apparatus results which is difficult to house in the necessarily small free space in a dobby.

It is a principal object of the present invention to overcome this drawback by providing an electromagnetic control device for the dobby which is simple in construction, of reduced dimensions and with perfectly satisfactory operational reliability, whatever the operating speed of the weaving machine with which the dobby is associated.

The invention consists substantially in providing one assembly of electromagnets, mounted on a chassis an oscillating movement associated with that of the dobby in order cyclically to bring and take said electromagnets towards and away from the different pairs of control hooks of the dobby. The invention further interposes between each of the electromagnets and the corresponding pair of control hooks a single selector pivotally borne by the said chassis. Each selector is associated with elastic spring means which tend to move it away from the poles of attraction of its electro magnet, but, when it is in spaced apart position, this selector abuts a stop so as to be returned into a position applied against said poles when, during its oscillating movement, the chassis moves away from the pairs of hooks.

It will be readily understood, under these conditions, that, depending on whether or not the associated electro-magnet is energized by the reading apparatus as a function of the weave program, the selector will remain applied or, on the contrary, be moved away by its elastic spring means, so that, when the chassis again moves towards the pairs of hooks, this selector will bear against one or against the other of the hooks of the pair in question. It should be observed that, in such a structure, the electromagnets never are required to effect positive displacement of the selectors; their role being limited to retaining, against the elastic spring means, the selector which is applied against their poles, or on the contrary to releasing it, so that the effort which they furnish is much reduced.

Furthermore, the fact that there is only one electromagnet unit considerably simplifies the control by the reading apparatus and at the same time substantially reduces the general over-all dimensions. The pivoting selectors interposed between the electromagnets and the pairs of hooks may perform a role of force amplification which simplifies the construction and which enables weaker supply currents to be employed.

The invention will be more readily understood on reading the following description with reference to the accompanying drawings, in which.

Figure 1:
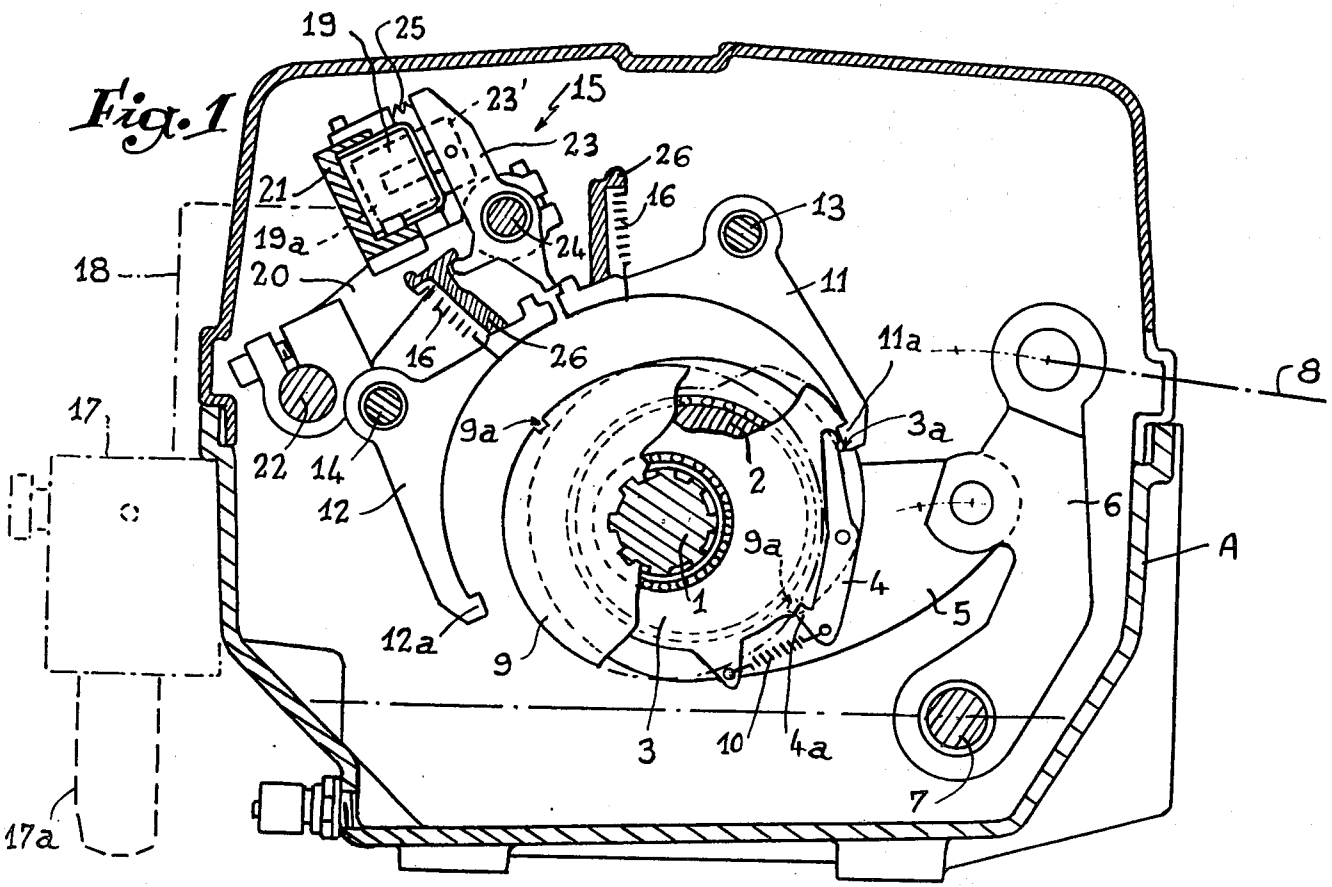
FIG. 1 is a schematic transverse section illustrating the general arrangement of an electromagnetic device according to the invention for controlling a dobby of the rotating type.
Figure 2:
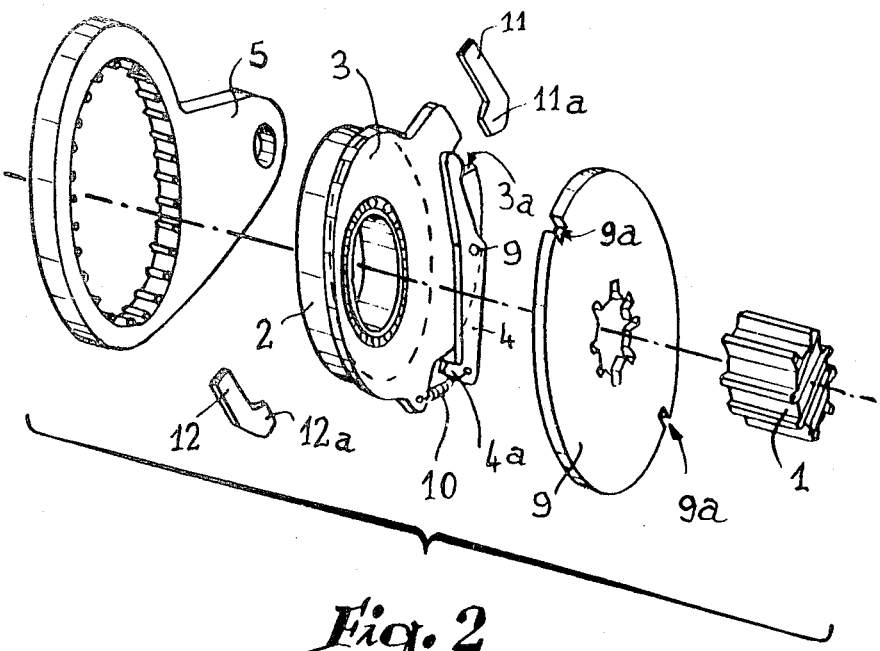
FIG. 2 shows the pieces forming one of the amplifier systems of the rotating dobby according to FIG. 1.
Figure 3:
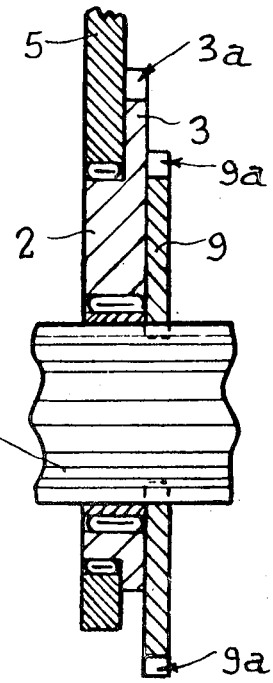
FIG. 3 is a longitudinal section to a larger scale, representing in the mounted state the pieces of the assembly according to FIG. 2.

Referring now to the drawings, the rotating dobby illustrated in FIGS. 1 to 3 is of the type forming the subject matter of U.S.A. patent application Ser. No.

407,512 filed by Applicants on Aug. 12, 1982. The main shaft 1, connected to the input shaft of the dobby through a modulator mechanism so as to achieve intermittent movement of rotation with stops every 180°, supports the different amplifier systems of the dobby. As shown more particularly in FIGS. 2 and 3, each system comprises an eccentric 2 mounted idly on the shaft 1 and provided with a lateral plate 3 on which a pawl 4 is laterally pivoted. The eccentric 2 is engaged in the opening of a connecting rod 5 which is coupled, via an arm 6 (FIG. 1) pivoting on a fixed spindle 7, with the conventional drawing lever (schematically shown at 8) connected to the heddle frame which corresponds to the illustrated needle of the dobby.

Each of the amplifier systems further comprises a circular disc or driver 9 of which the central opening is provided to be crenelated to cooperate with the longitudinal channels in the main shaft 1. At two diametrically opposite points of its periphery, this disc 9 is provided with two notches 9*a* (FIG. 2) which are adapted to cooperate with a finger 4*a* arranged at one of the ends of the coupling pawl 4. The opposite end of the latter is disposed at the level of a notch 3*a* made in the periphery of the plate 3 fixed to the eccentric 2. It will be observed that a spring 10 (FIG. 1), interposed between a radial lug of the plate 3 and the pawl 4, tends to maintain the finger 4*a* pressed against the periphery of the disc 9.

As described in the Patent Application mentioned above, each needle of the dobby is actuated with the aid of two pivoting actuating hooks 11 and 12 presenting two arms oriented at right angles on either side of a fixed pivot pin 13, 14 respectively borne by the walls of the casing A of the dobby. One of the arms of each hook is shaped to present a nose 11*a*, 12*a* adapted to engage, as will been seen hereinbelow, in a notch 3*a* in the plate 3 to push the pawl 4 whenever the shaft 1 stops and thus uncoupled and immobilise the eccentric 2 with respect to the drive disc 9. The other arm, adapted to receive the action of the control device according to the invention, generally reference 15, is urged to pivot by a spring 16 which thus tends to engage the nose 11*a*, 12*a* respectively, in a notch 3*a*. The control device 15 comprises a reading apparatus shown schematically at 17, arranged to read the information on a weave program, assumed to be formed by a chain of punched cards 17*a*. This information is converted by the apparatus 17 into electrical pulses which are sent by a cable 18 to one control unit comprising multiple electro-magnets 19, advantageously of the type described in French patent application No. 80 10548 filed by Applicants on May 6, 1980. This unit 19 contains a series of electromagnets in a number equal to that of the needles of the dobby envisaged, each electro-magnet 19*a* receiving from the apparatus 17 the pulses corresponding to its needle.

The unit 19 is borne by a chassis formed by two arms 20 connected to one another by a section 21 fixed to said unit. The two arms 20 are fixed on a shaft 22 which is driven from the input shaft of the dobby via a modulator, so as to perform an oscillating movement.

Figure 4:
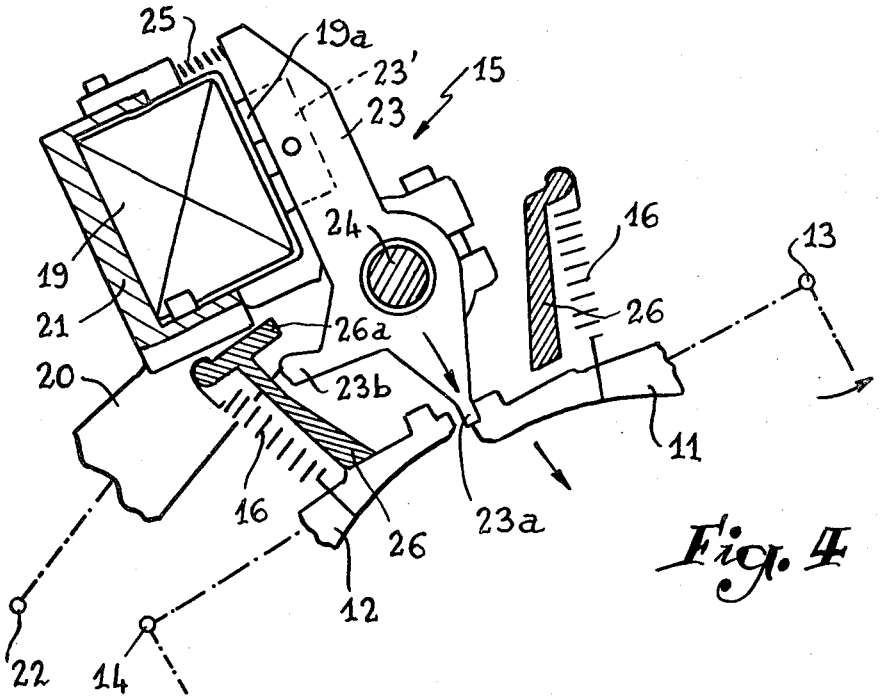
FIGS. 4 to 7 are partial sections to a larger scale, illustrating the operation of the control device according to FIG. 1.
Figure 5:
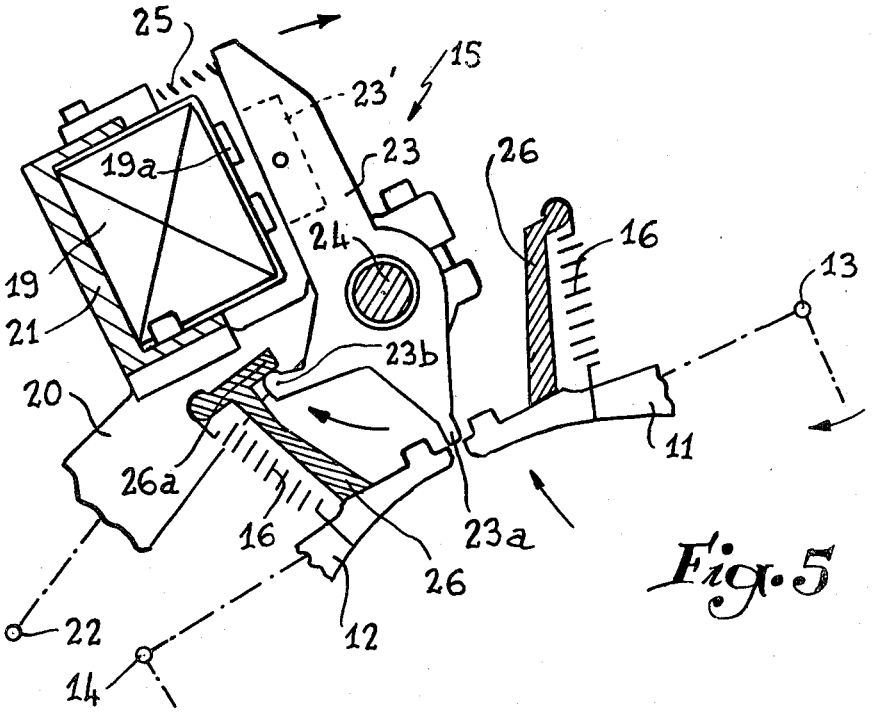

In addition to the reading apparatus 17 and the electromagnet unit 19 borne by the oscillating chassis 20–21, the control device 15 further comprises a series of selectors 23, in number equal to that of the needles of the dobby, all these selectors freely pivoting on a spindle 24 whose ends are fixed to the arms 20 of the above-mentioned chassis. Each selector 23 is provided with a metal armature plate 23' pivotally fixed and adapted to cooperate with the poles of the electromagnet 19*a* which corresponds thereto in the unit 19, it being observed that a spring 25 (FIG. 4) tends to move said selector away from the said poles. The lower part of each of the selectors 23 is shaped to define a sort of nose 23*a* adapted to act, as will be seen hereinbelow, on the corresponding end or tail of the pivoting hooks 11 or 12, whilst it laterally comprises a catch 23*b* which cooperates with a fixed stop 26*a* provided on one of two cross pieces 26 fixed in the casing A below the lowest point of the oscillating stroke of the unit 19.

Operation of the control device described hereinabove will follow from an examination of FIGS. 4 to 7, but, to set it forth logically, reference will firstly be made to FIG. 1 where it has been assumed that the oscillating chassis 20–21 was in the top position of its stroke; the electro-magnet 19*a* of the unit 19 which corresponds to the selector 23 shown is energized, so that the selector is applied against the poles of said electro-magnet, against the action of its spring 25. The two springs 16 maintain the pivoting hooks 11 and 12 in abutment against the lower part of the fixed stops 26.

Figure 8:
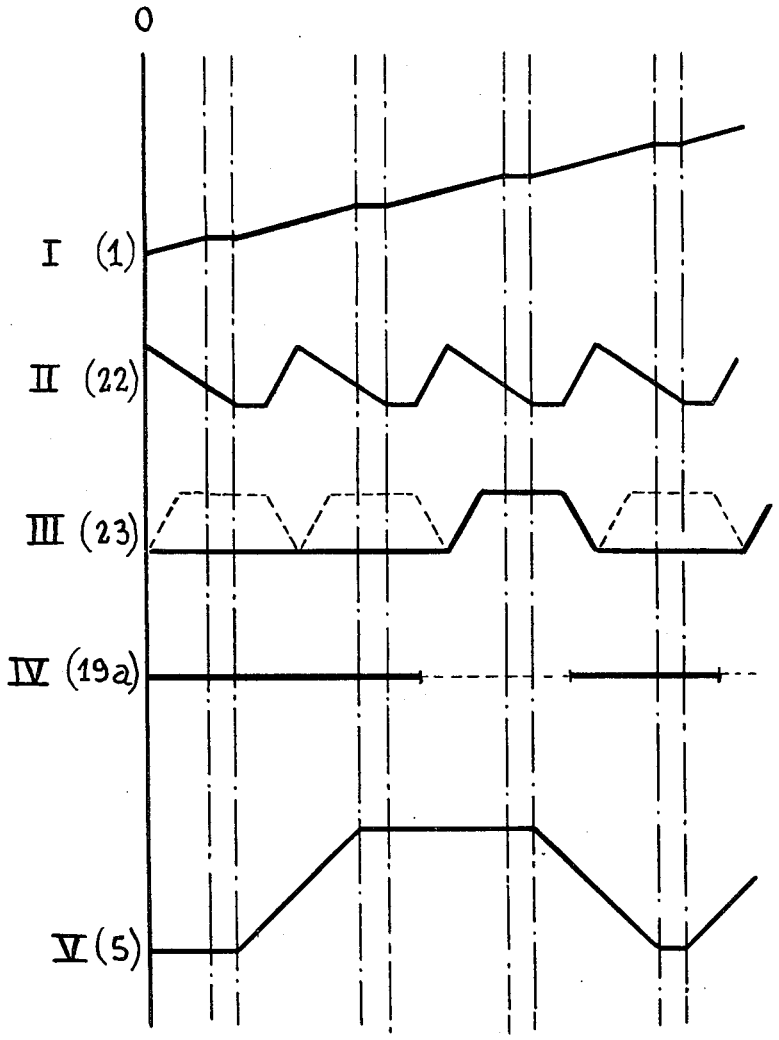
FIG. 8 is the diagram of the movements of the different mobile elements of the dobby according to FIGS. 1 to 7.

The diagram of the movements of FIG. 8 should also be observed beforehand, in which line I corresponds to the intermittent displacement of the shaft 1, whilst line II corresponds to the oscillating displacement of the shaft 22 and chassis 20–21. It may be observed that the shaft 1 starts a rotation through 180° when the chassis 20–21 arrives at the end of its stroke. Of course, the vertical displacements of the selector 23 are associated with those of the chassis 20–21, its angular movement appearing in line III of the diagram; it may be seen that this selector 23 is normally applied against the electromagnet 19*a* when the above-mentioned chassis arrives in top position. Finally, it will be noted that the electric control of the electro-magnets of unit 19 occurs (line IV) at the moment when the chassis 20–21 starts its ascending stroke.

Starting, therefore, from the position shown in FIG. 1. (point O of FIG. 8), it is seen that, during rotation of the shaft 1, the oscillating chassis lowers in the direction of hooks 11 and 12 (FIG. 4) and that the electro-magnet 19*a*, maintained energized, retains selector 23 in the applied position so that the nose 23*a* thereof abuts against the tail of the hook 11 whose nose 11*a* is thus retracted. Pivoting of this hook 11 against its spring 16 provokes withdrawal of the nose 11*a* from the notch 3*a* in the plate 3; the pawl 4 is released and therefore pivots under the effect of its spring 10 to engage its nose 4*a* in whichever notch 9*a* in the disc 9 is disposed immediately opposite. The eccentric 2 is then angular latched with the shaft 1 through the plate 3, the pawl 4 and the disc 9, so that, as soon as the shaft 1 starts a new rotation of 180°, the connecting rod 5 in question is actuated and therefore actuates the drawing lever 8 and the heddle frame associated therewith (line V of the diagram of FIG. 8).

At the end of angular displacement of the shaft 1, the pawl 4 is disposed opposite the nose 12*a* of the hook 12, which nose has elastically engaged in the notch 3*a*. At that moment and if, as has been assumed, the electromagnet 19*a* is still energized the selector 23 remains applied against the poles of said electro-magnet, so that, when the chassis 20–21 lowers, this selector will again actuate the hook 11, FIG. 4. However, this actuation will have no effect since, at that moment, the pawl 4 can be actuated only by the hook 12. The latter not being controlled, the nose 12*a* remains engaged in the notch 3*a* and therefore renders the plate 3 and eccentric 2 immobile. The drawing lever 8 remains in the leftward position corresponding to raising of the heddle frame, as shown in the diagram 8V.

Figure 6:
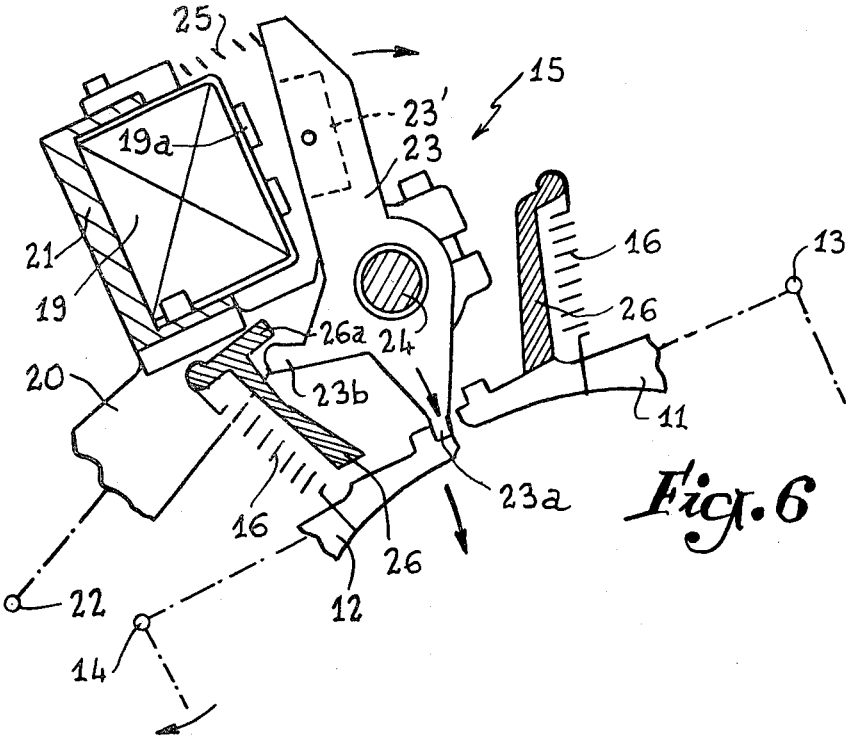
Figure 7:
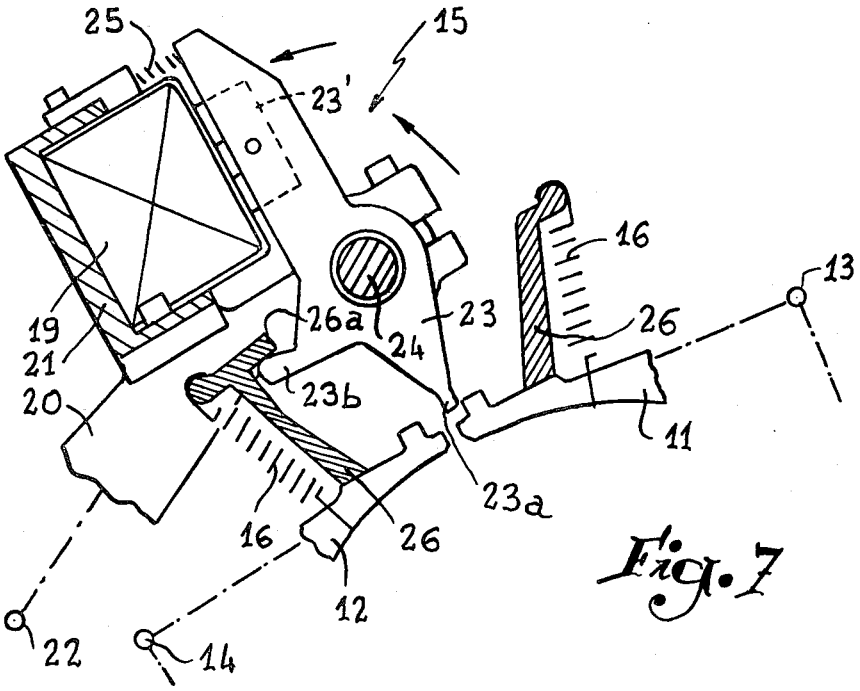

On the other hand, if for the following period the reading apparatus 17 has stopped energizing the electromagnet 19*a*, the selector 23 detaches therefrom in the course of the ascending stroke of the chassis 20–21 (FIG. 5), so that, when this chassis begins its descending stroke according to FIG. 6, the nose 23*a* will actuate the tail of the hook 12. The nose 12*a* is withdrawn from notch 3*a* and the pawl 4 elastically introduces its nose 4*a* into the corresponding notch 9*a* in the disc 9. As a result of the drive of the eccentric 2 thus effected, the connecting rod 5 returns to its initial position and the corresponding heddle frame moves down.

In the course of the ascending stroke of the chassis 20–21, the catch 23*b* of the selector 23 always bears against the stop 26*a* (FIG. 7), so that this selector is automatically tilted so as to apply against the poles of the electro-magnet 19*a*. Under these conditions, it is clear that this selector may or may not be retained by the electromagnet as a function of the desired control for the connecting rod.

Finally, it will be understood that the arrangement according to the invention allows the dobby to be controlled without the electro-magnets contained in the unit 19 having to exert an effort greater than that exerted by the return spring 25 of each selector 23.

Figure 9:
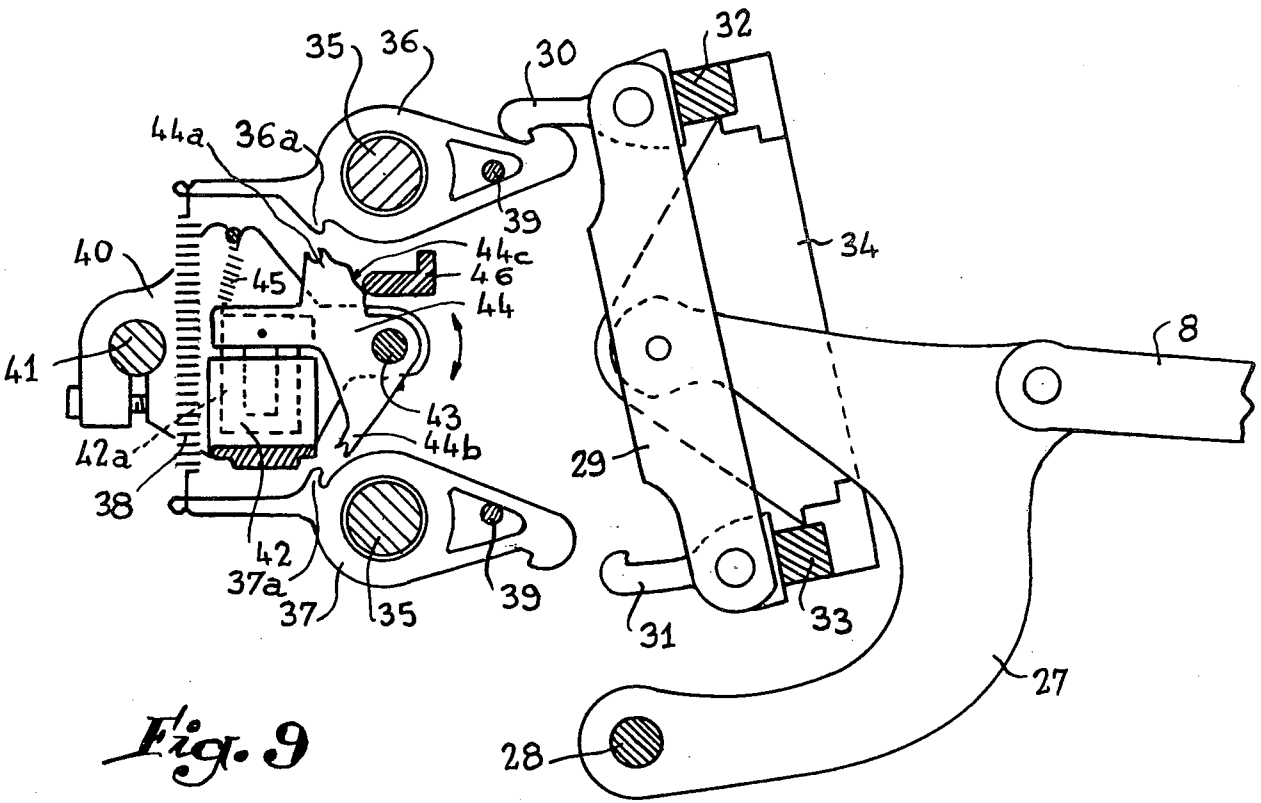
FIG. 9 is a section showing the arrangement of an electromagnetic device according to the invention for controlling a dobby of the type with double swinging levers.

FIG. 9 schematically illustrates the application of the control device according to the invention to a dobby of the type with double swinging levers. It will be recalled that, in such a dobby, each of the drawing levers 8 associated with the heddle frames is coupled to an actuating lever 27 which pivots at 28 and which pivotally supports a double swinging lever 29. Each double swinging lever 29 is formed by sort of double lever provided at each of its ends with a coupling hook 30, 31 respectively. A cross piece 32, 33 respectively abuts cyclically against the rear catch of each hook 30, 31 of the double swinging lever 29, said two cross pieces being mounted on a side element 34 animated by an oscillating movement.

In front of each double swinging lever 29 are provided two fixed spindles 35 on each of which pivots a retaining actuating hook 36, 37 adapted to cooperate with the coupling hook 30, 31 respectively of the double swinging lever. A spring 38 tends to maintain the actuating hooks 36 and 37 in an outer position for which they are in a position to engage with the hooks 30 and 31, stops 39 limiting the angular displacement of said hooks 36 and 37.

The device according to the invention comprises, as in the preceding embodiment, a chassis 40 fixed on a shaft 41 performing an oscillating movement. This chassis supports an electromagnet unit 42 identical to that referenced 19, as well as a spindle 43 on which are idly mounted a number of selectors 44 equal to that of the electro-magnets 42*a* of the said unit. A spring 45 tends to maintain each selector 44 in contact with a fixed stop 46.

As better illustrated in FIGS. 10 to 13, each selector 44 is provided with two opposite extensions 44*a*, 44*b* respectively, in order to ensure actuation of the retaining hooks 36 and 37, provided for this purpose with a nose 36*a*, 37*a* respectively. It should be observed that these noses 36*a* and 37*a* are disposed on the hooks 36 and 37 to the rear of the fixed pivots or spindles 35, so that, when said hooks are pushed by the nose which is associated therewith, their right-hand ends which are adapted to cooperate with the corresponding coupling hook 30, 31 are displaced inwardly, therefore moving away from the associated hook.

Operation will be very succinctly set forth with reference to FIGS. 10 to 13 and to FIG. 14 which shows the diagram of the movements for a particular weave. This diagram is similar to that of FIG. 8, in that:

line I shows the oscillating displacement of the side element 34 and the actuation of the two cross pieces 32 and 33 which act on the double swinging lever 29;

line II shows the oscillating displacement of the shaft 41 which bears the chassis 40 and the magnet unit 42;

line III shows the angular movement of the selector 44 as illustrated (the low point corresponding to application against the poles of the electro-magnet 42*a*);

and line IV shows the energizing of this electro-magnet 42*a* (the continuous line corresponding to supply).

Figure 10:
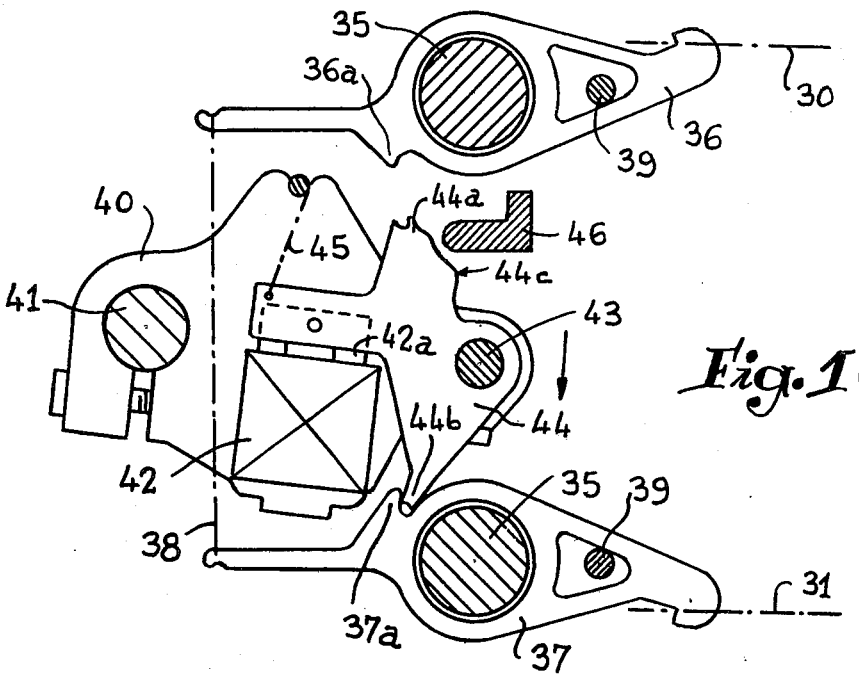
FIGS. 10 to 13 show, to a larger scale, the operation of this device.
Figure 11:
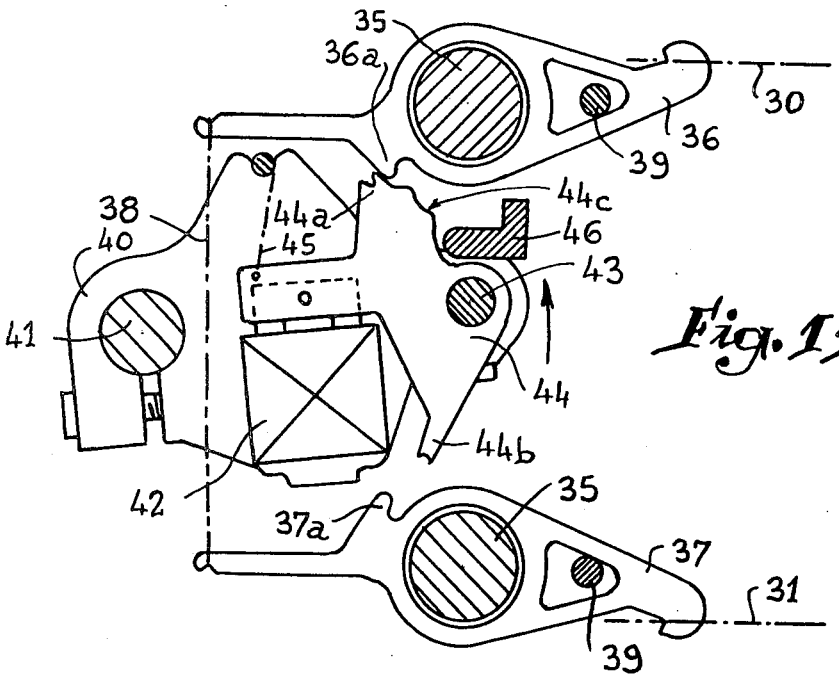

In FIG. 10, the chassis 40 is shown in its descending stroke with the selector 44 applied against the electromagnet 42*a*. The extension 44*b* escapes the nose 37*a* of the retaining hook 37 which is therefore not manoeuvred, so that the lower coupling hook 31 is engaged by the actuating hook 35, ensuring control of the lever 8 and of the corresponding heddle frame. FIG. 11 shows that, in the same way, the upper hooks 36 and 30 remain engaged when the selector 44, still retained against the electro-magnet 42*a* which is assumed to be energized moves upwardly with its extension 44*a* in retracted position with respect to nose 36*a*.

Figure 12:
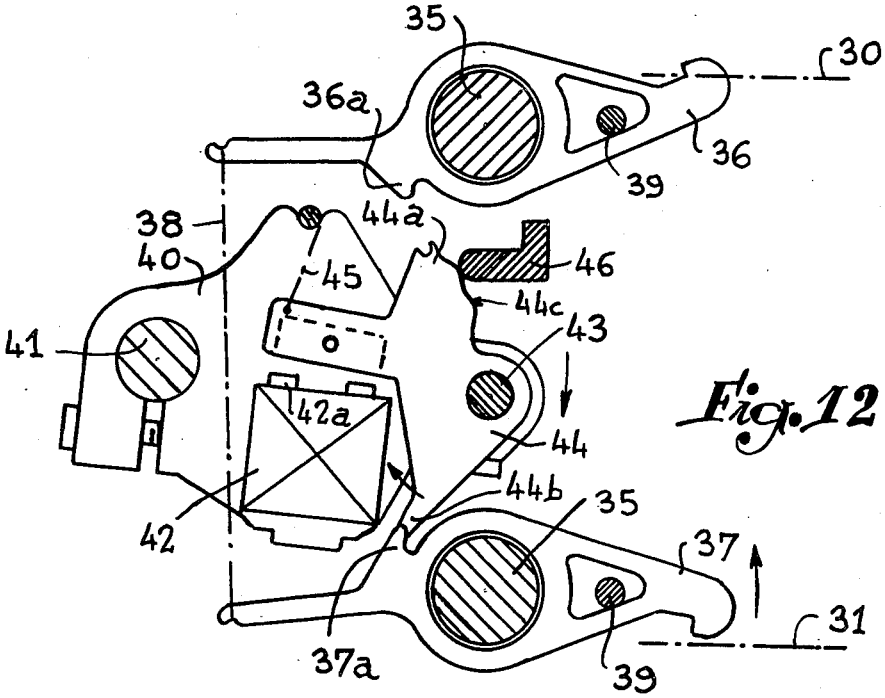

On the other hand, in FIG. 12, the selector 44 is assumed to have been returned into non-applied position by the spring 45, i.e. released by the magnet 42, the electro-magnet not being energized. The extension 44*b*, in the course of the descending stroke of the chassis 40 and the selector 44, buts against the nose 37*a* of the retaining hook 37. Under these conditions, the latter pivots counterclockwise and consequently escapes the coupling hook 31 of the double swinging lever.

Figure 13:
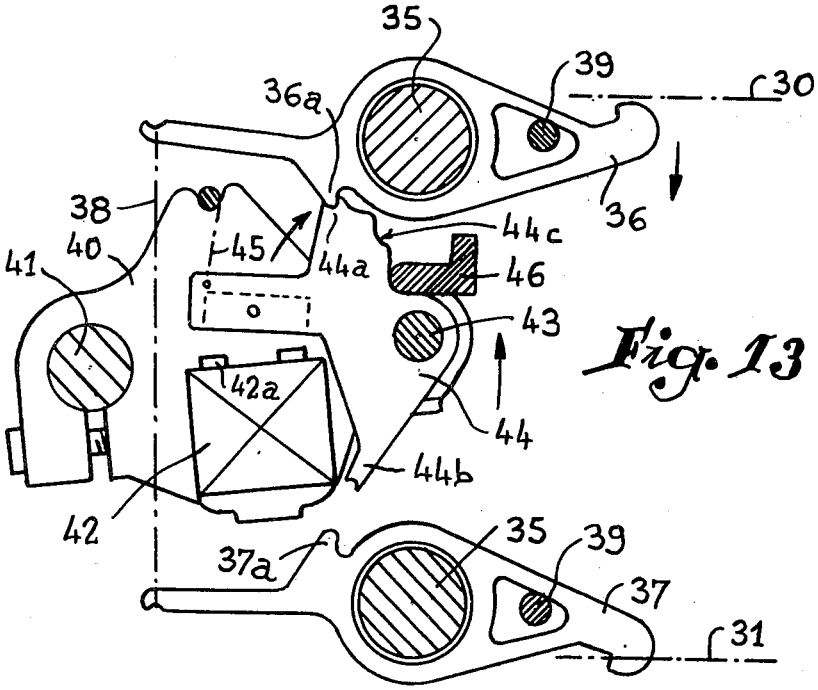
Figure 14:
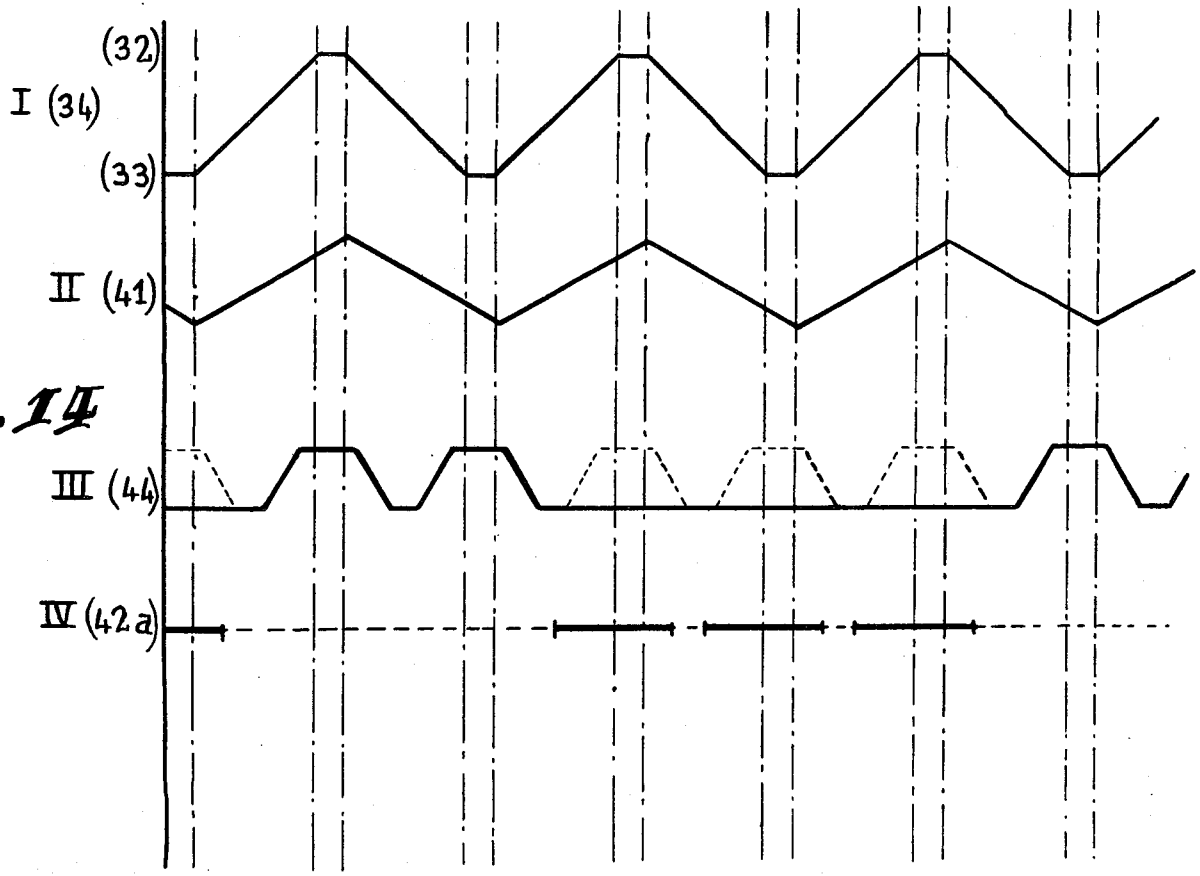
FIG. 14 is the diagram of the movements.

The situation is the same in FIG. 13 where the selector 44, not retained by the electro-magnet 42*a*, is shown during the ascending stroke of the chassis 40, in order to raise the nose 36*a* and to retract the upper hook 36 out of contact with respect to the coupling hook 30.

In FIGS. 12 and 13, and FIG. 9 which shows the mobile pieces in a mean position, it may be seen that, during the return movement of the oscillating chassis 40 with the selector 44 in released position with respect to the electro-magnet 42*a*, the shaped portion 44*c* of the edge of this selector which cooperates with the fixed stop 46 automatically ensures the return of the selector into a position where it is applied against the poles of the electro-magnet 42*a*, so that the latter may, if the weave program reading apparatus energizes it, retain the abovementioned selector.

It must be understood that the preceding description has been given only by way of example and that it in no way limits the domain of the invention, replacement of the details of execution described by any other equivalents not departing from the scope of the invention. In particular, it will be observed that although the mobility of the electro-magnet unit and the selectors enables these latter to be returned into the applied position due to stops 26 rigidly fixed in the casing, suitably controlled mobile stops may in certain cases by employed.

What is claimed is:

1. An electromagnetic control device for controlling each pair of actuating hooks of the weaving system of a loom including heddles and including a pattern reading device operative in cycle with the loom to deliver electrical output signals to the control device, and the weaving system including a force amplifier system cooperatively associated with each pair of actuating hooks and including drawing means connected between the force amplifier systems and the heddles, said control device comprising:

(a) a chassis supported on the loom adjacent to the force amplifier systems and operative to oscillate between two opposed positions in cycle with the loom;

(b) an electromagnet corresponding with each pair of actuating hooks and each electromagnet being coupled to receive output signals from the pattern reading device, the electromagnets being mounted on the chassis to oscillate therewith and each electromagnet being located opposite an associated pair of actuating hooks; and (c) a selector member corresponding with each electromagnet and associated pair of actuating hooks, the selector members being pivotally mounted on the chassis and oscillating therewith, and each selector member being pivotable between an engaged position in which it is held against its electromagnet when energized and a released position wherein it is pivoted away from its electromagnet when de-energized, and each selector member having engaging means operative in some of said opposed positions of the chassis and in some pivotal positions of the selector means to selectively engage and displace one or the other of the hooks of the associated pair.

2. In an electromagnetic control device as claimed in claim 1, spring means yieldably urging the selector members to pivot out of engagement with their electromagnets, and means located adjacent to the selector members and operative to pivot all of the selector members to apply them against their respective electromagnets at a position in the oscillation of the chassis wherein the members are out of contact with the associated actuating hooks.

3. In an electromagnetic control device as claimed in claim 2, said means to pivot the selector members to apply them against their electromagnets comprising a stop supported by the loom in fixed position adjacent to the oscillating chassis.

4. In an electromagnetic control device as claimed in claim 1, wherein the pairs of actuating hooks comprise parts of a rotating dobby driven in cycle with the loom, said pairs of actuating hooks comprising pivotally mounted hooks operatively associated with the rotating dobby and each having a tail portion located adjacent to one of the selector members, said engaging means on each selector member being located to selectively engage one or the other of the tail portions of the associated pair of hooks when the chassis oscillates toward the tail portions depending upon whether the selector member is in engaged or released position relative to its electromagnet.

5. In an electromagnetic control device as claimed in claim 1, wherein the pairs of actuating hooks comprise parts of a dobby of the double swinging lever type driven in cycle with the loom and having coupling hooks disposed to be engaged by said actuating hooks, said oscillating chassis being located between the pairs of actuating hooks and operative to oscillate alternately toward one and the other thereof, and each selector member having opposed extension portions disposed such that in one pivotal position of the selector member an extension portion will engage and displace an actuating hook when the chassis oscillates toward it and such that in the other pivotal position the extension portion will remain out of engagement with the hook.

* * * * *